US008602795B2

(12) United States Patent
Hsu

(10) Patent No.: US 8,602,795 B2
(45) Date of Patent: Dec. 10, 2013

(54) ELECTRICAL CONNECTOR

(75) Inventor: Ying-Hao Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/448,442

(22) Filed: Apr. 17, 2012

(65) Prior Publication Data

US 2013/0040469 A1 Feb. 14, 2013

(30) Foreign Application Priority Data

Aug. 10, 2011 (TW) ..... 100128618

(51) Int. Cl.
*H01R 11/30* (2006.01)

(52) U.S. Cl.
USPC ..... 439/39

(58) Field of Classification Search
USPC ..... 439/39, 22, 21
See application file for complete search history.

(56) References Cited

U.S. PATENT DOCUMENTS

| | | | | |
|---|---|---|---|---|
| 3,521,216 | A * | 7/1970 | Tolegian | 439/39 |
| 5,401,175 | A * | 3/1995 | Guimond et al. | 439/38 |
| 7,344,380 | B2 * | 3/2008 | Neidlein et al. | 439/39 |
| 8,398,409 | B2 * | 3/2013 | Schmidt | 439/39 |
| 2007/0072443 | A1 * | 3/2007 | Rohrbach et al. | 439/39 |
| 2008/0305649 | A1 * | 12/2008 | Didur et al. | 439/39 |
| 2011/0159705 | A1 * | 6/2011 | Schmidt | 439/39 |

* cited by examiner

*Primary Examiner* — Phuong Dinh
(74) *Attorney, Agent, or Firm* — Altis Law Group, Inc.

(57) ABSTRACT

An electrical connector includes a first connector, and a second connector detachably coupled to the first connector. The first connector has a first magnetic body and at least one first conductive body. The second connector has a second magnetic body and at least one second conductive body. The first magnetic body is capable of magnetically attracting the second magnetic body to form a sealed enclosure to receive the at least one first conductive body and the at least one second conductive body. The at least one first conductive body electrically connects to the at least one second conductive body when the first magnetic body is magnetically bound to the second magnetic body.

18 Claims, 4 Drawing Sheets

ELECTRICAL CONNECTOR

BACKGROUND

1. Technical Field

The present disclosure relates to electrical connectors.

2. Description of Related Art

Electrical connectors are used to electrically connect two electronic devices, and enable the two electronic devices to exchange signals with each other. The electrical connector uses metal pins, but the metal pins are small and delicate and not amenable to high numbers of connection/disconnection cycles.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
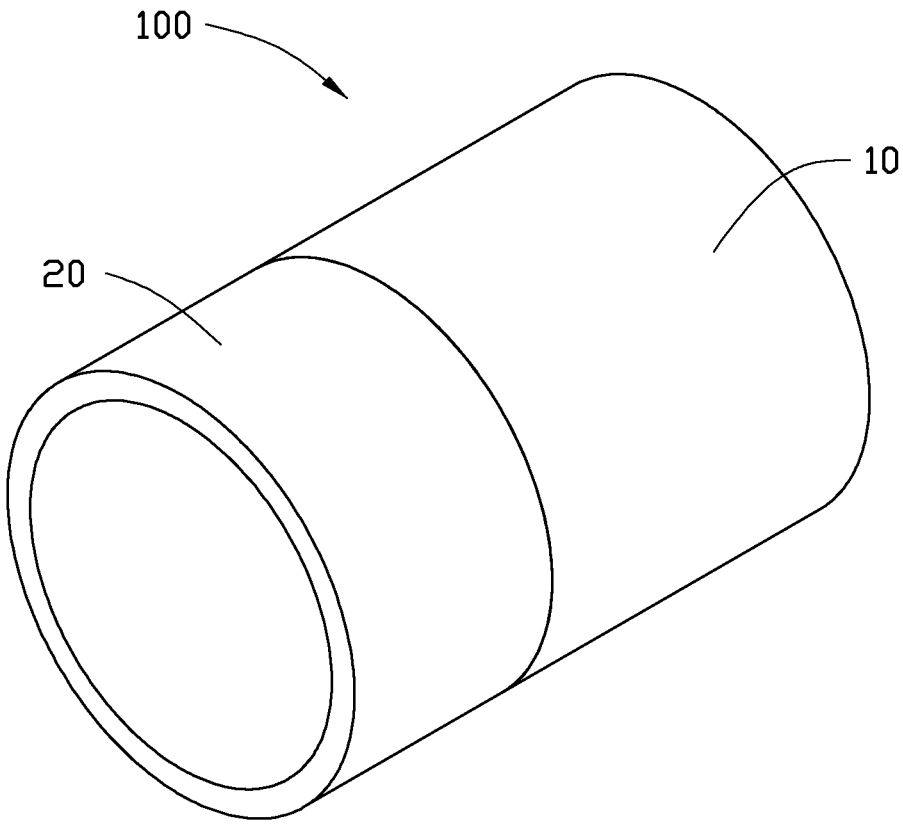
FIG. 1 is an isometric view of an electrical connector.
Figure 2:
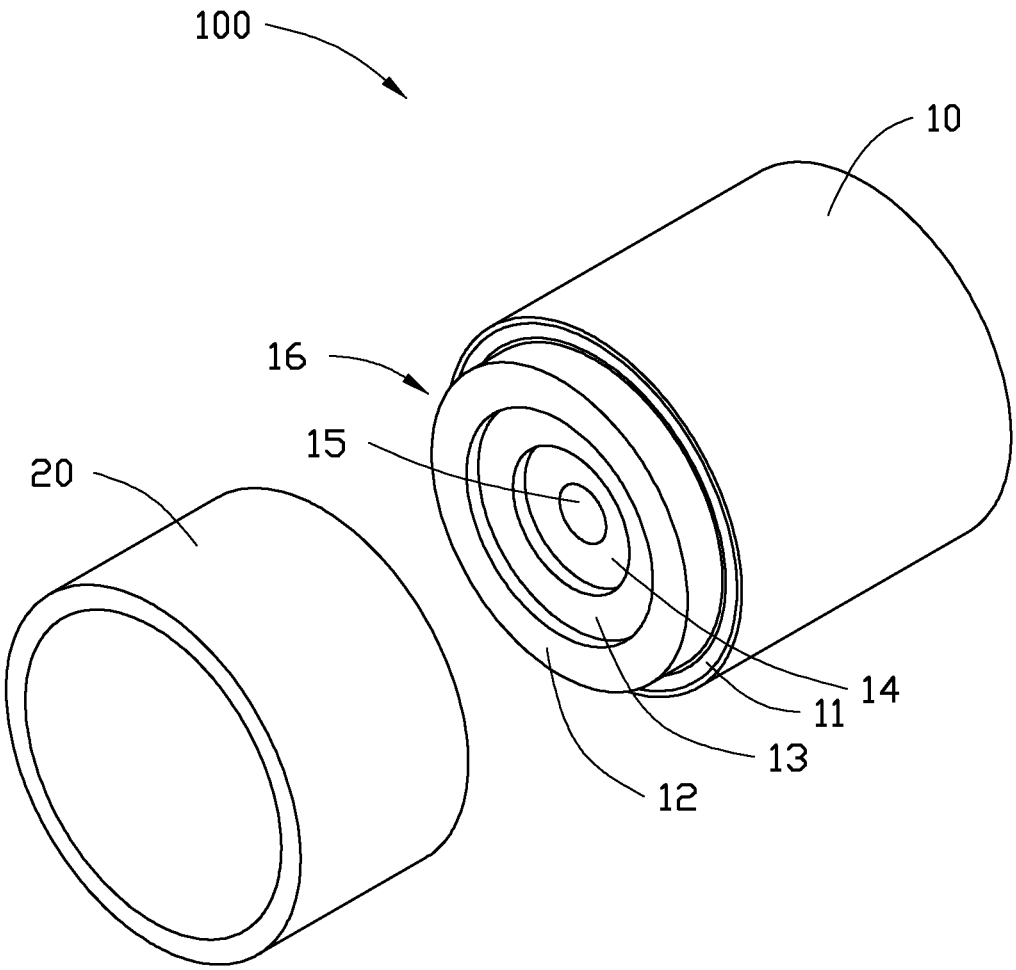
FIG. 2 is an exploded view of the electrical connector of FIG. 1.
Figure 3:
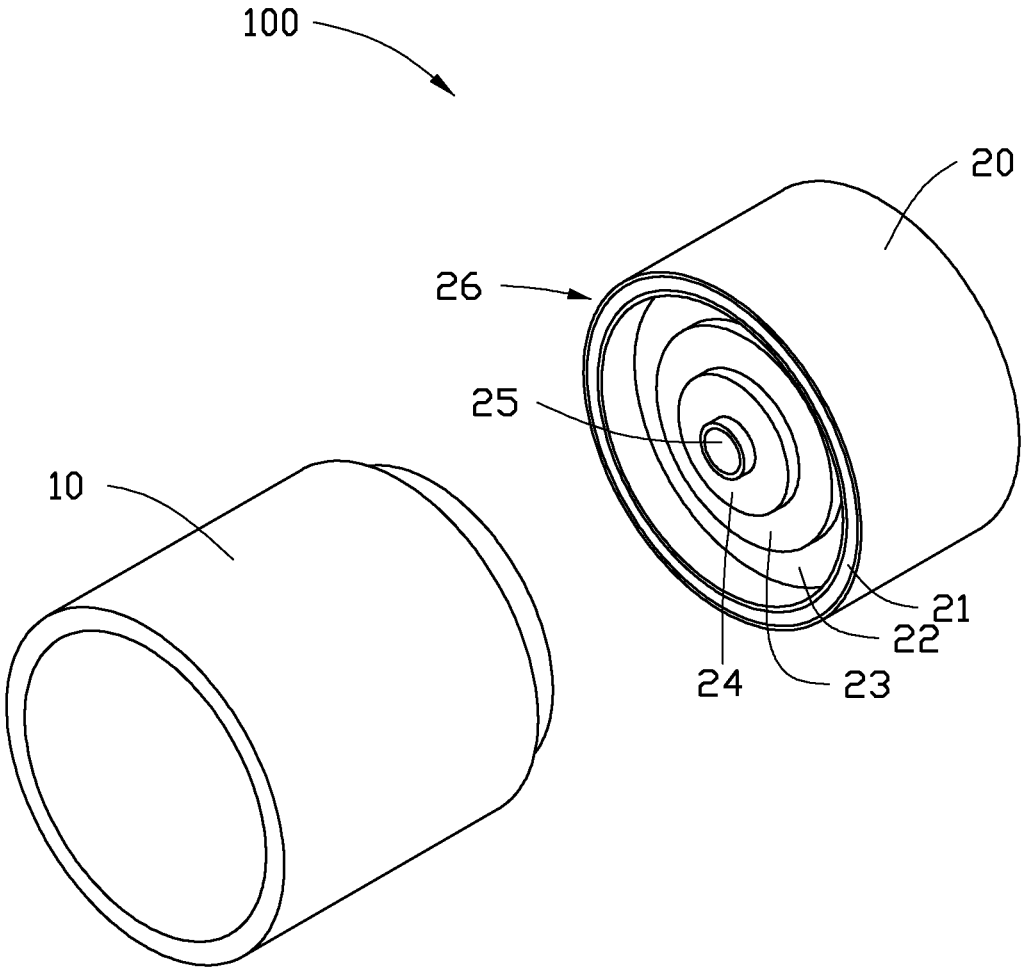
FIG. 3 is similar to FIG. 2, but viewed from an opposite aspect.

FIGS. 1-3 show an electronic connector 100 having a first connector 10, and a second connector 20 detachably sleeved on the first connector 10. The first connector 10 electrically connects with a first electronic device (not shown), and the second connector 20 electrically connects with a second electronic device (not shown). Thus, the first electronic device is electrically connected to the second electronic device when the first connector 10 is coupled to the second connector 20.

The first connector 10 is insulated externally. One end of the first connector 10 is a hollow cylinder. The other end of the first connector 10 has a first magnetic body 11, a first conductive body 12, a second conductive body 13, a third conductive body 14, and a second magnetic body 15. The first magnetic body 11, the first conductive body 12, the second conductive body 13, the third conductive body 14 are all annular. The second magnetic body 15 is columnar. The second magnetic body 15 is positioned at the center of the first connector 10. The first magnetic body 11 surrounds the second magnetic body 15. The first, the second, and the third conductive bodies 12, 13, and 14 are positioned in that order between the first magnetic body 11 and the second magnetic body 15. The first magnetic body 11, the first conductive body 12, the second conductive body 13, the third conductive body 14, and the second magnetic body 15 are concentrically arranged.

A single cross section of the first magnetic body 11, the first conductive body 12, the second conductive body 13, the third conductive body 14, and the second magnetic body 15 forms a protruding and a first inserting surface 16. A single cross section of the first conductive body 12, the second conductive body 13, the third conductive body 14, and the second magnetic body 15 forms annular steps inward and down. The cross sections of the second magnetic body 15 and of the first magnetic body 11 are coplanar. There are non-conductive concentric first gaps 17 between every adjacent two of the first, the second, and the third conductive bodies 12, 13, and 14 radially around the central axis of the first connector 10. Thus, the first, the second, and the third conductive bodies 12, 13, and 14 cannot connect electrically.

The external surface of the second connector 20 is electrically insulated. One end of the second connector 20 is a hollow cylinder. The other end of the first connector 10 has a third magnetic body 21, a fourth conductive body 22, a fifth conductive body 23, a sixth conductive body 24, and a fourth magnetic body 25.

The fourth magnetic body 25 is columnar and positioned at the center of the second connector 20. The third magnetic body 21 surrounds the fourth magnetic body 25. The fourth conductive body 22, the fifth conductive body 23, and the sixth conductive body 24 are positioned in that order between the third magnetic body 21 and fourth magnetic body 25. The third magnetic body 21, the fourth conductive body 22, the fifth conductive body 23, the sixth conductive body 24, and the fourth magnetic body 25 are all annular and concentrically arranged. The annular diameters of the third magnetic body 21, the fourth conductive body 22, the fifth conductive body 23, the sixth conductive body 24, and the fourth magnetic body 25 match those of the first magnetic body 11, the first conductive body 12, the second conductive body 13, the third conductive body 14, and the second magnetic body 15 respectively. A single cross section of the fourth magnetic body 25, the sixth conductive body 24, the fifth conductive body 23, the fourth conductive body 22, and the third magnetic body 21 forms a second inserting surface 26. A single cross section of the fourth magnetic body 25, the sixth conductive body 24, the fifth conductive body 23, the fourth conductive body 22 forms annular steps outward and up, and substantially matches and accommodates the cross-sectional profile of the first conductive body 12, the second conductive body 13, the third conductive body 14, and the second magnetic body 15. The cross sections of the third magnetic body 21 and of the fourth magnetic body 25 are coplanar. There are second gaps 27 (see FIG. 4) between every adjacent two of the fourth magnetic body 25, the sixth conductive body 24, the fifth conductive body 23, which provide the same function as the first gaps 17 (see FIG. 4) but in relation to the fourth conductive body 22, the fifth conductive body 23, and the sixth conductive body 24. The annular face of the third magnetic body 21 meets the annular face of the first magnetic body 11. The magneticic pole of the first magnetic body 11 on the first inserting surface 16 is opposite to the magneticic pole of the third magnetic body 21 on the second inserting surface 26. The circular face of the fourth magnetic body 25 meets the circular face of the second magnetic body 15. The magneticic pole of the second magnetic body 15 on the first inserting surface 16 is the same with that of the first magneticic pole of the first magnetic body 11 on the first inserting surface 16, and opposite to that of the fourth magnetic body 25 on the second inserting surface 26.

Figure 4:
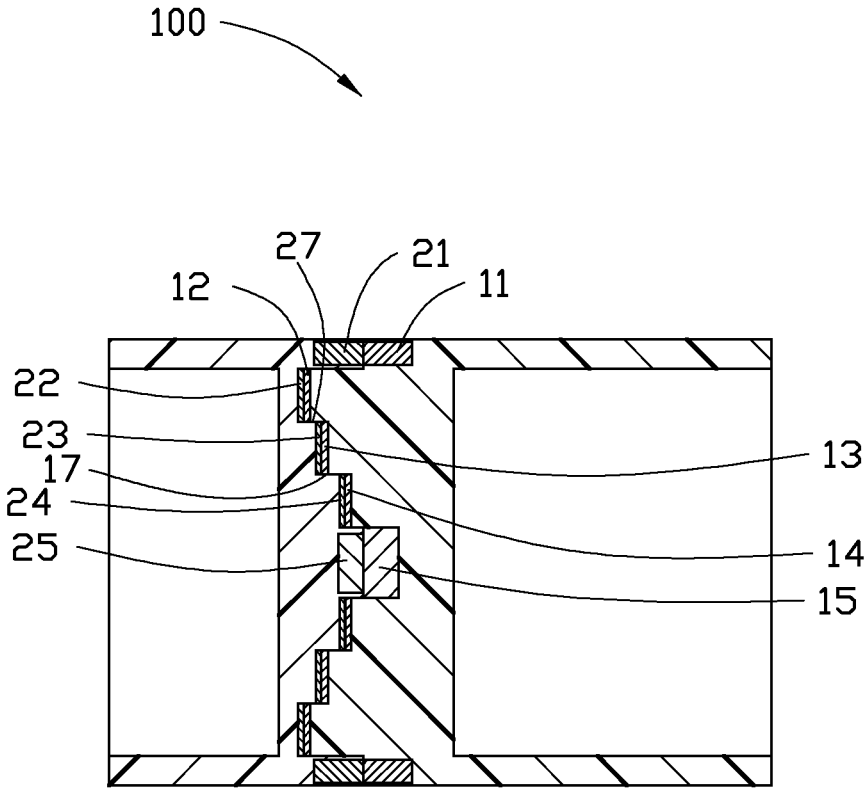
FIG. 4 is a cross-sectional view of the electrical connector in FIG. 1.

Referring to FIG. 4, the manner of operation of the electrical connector 100 is described. For example, the first inserting surface 16 is coupled to the second inserting surface 26, so the first magnetic body 11, the first conductive body 12, the second conductive body 13, the third conductive body 14, and the second magnetic body 15 make respective contact with the third magnetic body 21, the fourth conductive body 22, the fifth conductive body 23, the sixth conductive body 24, and the fourth magnetic body 25. Thus, the first magnetic body 11 and the second magnetic body 15 respectively contact the third magnetic body 21 and the fourth magnetic body 25 to form a sealed room enclosing the six conductive bodies 12, 13, 14, 22, 23, and 24. The first, the second, and the third conductive bodies 12, 13, and 14 contact the fourth, fifth, and sixth conductive bodies 22, 23, and 24 when the first magnetic body 11 and the second magnetic body 15 are in respective contact with the third magnetic body 21 and the fourth magnetic body 25. The first connector 10 and the second connector 20 in this manner make an electrical connection with each other.

As described above, the cross section of the first magnetic body 11 is lower than that of the first, the second, and the third conductive bodies 12, 13, and 14. The cross section of third magnetic body 21 is higher than that of the fourth, the fifth, and the sixth conductive bodies 22, 23, and 24. Thus, the first connector 10 and the second connector 20 make firm and unequivocal contact, enhanced and strengthened by the mating structure of the two connectors of the electrical connector 100. The first and the second connectors 10 and 20 both include but are not limited to three conductive bodies.

The first magnetic body 11 and the second magnetic body 21 form a sealed enclosure, thus the ingress of dust and water is prevented, and the service life of the electrical connector 100 will be longer. Further, the first connector 10 and the second connector 20 using ring-shaped conductive bodies renders each one more difficult to damage. Moreover, the ring shaped conductive bodies will self-connect even if the two connectors are presented at an oblique angle, thus it is very convenient.

Even though relevant information and the advantages of the present embodiments have been set forth in the foregoing description, together with details of the functions of the present embodiments, the disclosure is illustrative only; and changes may be made in detail, especially in the matters of shape, size, and arrangement of parts within the principles of the present embodiments to the full extent indicated by the broad general meaning of the terms in which the appended claims are expressed.

What is claimed is:

1. An electrical connector comprising:

a first connector having a first magnetic body and at least one first conductive body, and a second connector to be detachably coupled to the first connector, the second connector having a second magnetic body and at least one second conductive body;

wherein the first magnetic body is capable of magnetically attracting the second magnetic body to form an enclosure to receive the at least one first conductive body and the at least one second conductive body, and the at least one first conductive body electrically connects to the at least one second conductive body when the first magnetic body is magnetically bound to the second magnetic body, the cross section of the first magnetic body is lower than that of the at least one first conductive body when viewed from a side of the first connector facing the second connector, the cross section of the second magnetic body is higher than that of the at least one second conductive body when viewed from a side of the second connector facing the first connector.

2. The electrical connector of claim 1, wherein the first magnetic body surrounds the at least one first conductive body, the second magnetic body surrounds the at least one second conductive body.

3. The electrical connector of claim 1, wherein the first connector comprises a third magnetic body, the second connector comprises a fourth magnetic body, the at least one first conductive body is positioned between the first magnetic body and the third magnetic body, the at least one second conductive body is positioned between the second magnetic body and the fourth magnetic body.

4. The electrical connector of claim 3, wherein the cross section of the third magnetic body and the cross section of the first magnetic body are coplanar, the cross section of the fourth magnetic body and the cross section of the second magnetic body are coplanar.

5. The electrical connector of claim 4, wherein the third and the fourth magnetic bodies are columnar.

6. The electrical connector of claim 4, wherein the third magnetic body and the first magnetic body are annular, the fourth magnetic body and the second magnetic body are annular.

7. The electrical connector of claim 1, wherein the at least one first conductive body and the at least one second conductive body are annular.

8. An electrical connector comprising:

a first connector having a plurality of first conductive bodies, and a second connector detachably sleeved on the first connector, the second connector having a plurality of second conductive bodies corresponding to the plurality of the first conductive bodies;

wherein the plurality of the first conductive bodies are annular and concentrically arranged, and the plurality of the first conductive bodies are separated from each other, the plurality of the second conductive bodies are annular and concentrically arranged, and the plurality of the second conductive bodies are separated from each other, the plurality of the first conductive bodies are electrically connected to the plurality of the second conductive bodies respectively when the first connector is sleeved on the second connector, the cross sections of the plurality of the first conductive bodies step down, the cross sections of the plurality of the second conductive bodies step up.

9. The electrical connector of claim 8, wherein the first connector comprises a first magnetic body, the second connector comprises a second magnetic body, the first magnetic body surrounds the plurality of the first conductive bodies, the second magnetic body surrounds the plurality of the second conductive bodies, the plurality of the first conductive bodies protrudes out of the first magnetic body, the second magnetic body protrudes from the plurality of the second conductive bodies, the first magnetic body contacts the second magnetic body.

10. The electrical connector of claim 9, wherein the first connector comprises a third magnetic body at the center of the first connector, the second connector comprises a fourth magnetic body at the center of the second connector, the cross sections of the third magnetic body and the first magnetic body are coplanar, the cross sections of the fourth magnetic body and the second magnetic body are coplanar.

11. The electrical connector of claim 8, wherein there is a first gap between every adjacent two of the plurality of the first conductive bodies along an axes of the first connector, and there is a second gap between every adjacent two of the plurality of the second conductive bodies along an axes of the second connector.

12. An electrical connector comprising:

a first connector having at least one first conductive body and a first magnetic body, and a second connector detachably sleeved on the first connector, the second connector having at least one second conductive body capable of contacting the at least one first conductive body, and a second magnetic body capable of magnetically attracting the first magnetic body;

wherein the first connector further comprises a third magnetic body at the center of the first connector, the second connector further comprises a fourth magnetic body at the center of the second connector, the at least one first conductive body is between the first magnetic body and the third magnetic body, the at least one second conductive body is between the second magnetic body and the fourth magnetic body.

13. The electrical connector of claim 12, wherein the first magnetic body surrounds the at least one first conductive body, the second magnetic body surrounds the at least one second conductive body.

14. The electrical connector of claim 13, wherein the at least one first conductive body protrudes out of the first magnetic body, the second magnetic body protrudes out of the at least one second conductive body.

15. The electrical connector of claim 14, wherein the first magnetic body and the second magnetic body are annular, and the first magnetic body and the second magnetic body have the same diameters.

16. The electrical connector of claim 15, wherein the cross sections of the third magnetic body and the first magnetic body are coplanar, the cross sections of the fourth magnetic body and the second magnetic body are coplanar.

17. The electrical connector of claim 12 wherein the third and the fourth magnetic bodies are columnar, and the third and the fourth magnetic bodies have the same diameters.

18. The electrical connector of claim 12, wherein the first magnetic body is positioned at the center of the least one first conductive body, the second magnetic body is positioned at the center of the at least one second conductive body.

* * * * *